US011229248B2

(12) United States Patent
Honjo

(10) Patent No.: US 11,229,248 B2
(45) Date of Patent: Jan. 25, 2022

(54) SUPPORTING GLOVE AND METHOD FOR MANUFACTURING THE SUPPORTING GLOVE

(71) Applicant: SHOWA GLOVE CO., Hyogo (JP)

(72) Inventor: Yoshimitsu Honjo, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 223 days.

(21) Appl. No.: 15/363,153

(22) Filed: Nov. 29, 2016

(65) Prior Publication Data

US 2017/0156422 A1 Jun. 8, 2017

(30) Foreign Application Priority Data

Dec. 2, 2015 (JP) ..... JP2015-235871

(51) Int. Cl.

*A41D 19/00* (2006.01)
*A41D 31/06* (2019.01)
*A41D 19/015* (2006.01)

(52) U.S. Cl.

CPC ..... *A41D 19/0082* (2013.01); *A41D 19/001* (2013.01); *A41D 19/0006* (2013.01); *A41D 19/0044* (2013.01); *A41D 31/065* (2019.02); *A41D 19/01529* (2013.01); *A41D 19/01558* (2013.01); *A41D 2400/10* (2013.01); *A41D 2500/10* (2013.01)

(58) Field of Classification Search

CPC ..... A41D 19/0001; A41D 19/0082; A41D 19/0006; A41D 19/0044; A41D 19/01558; A41D 19/01529; A41D 31/0038; A41D 2500/10; A41D 2400/10; A41D 31/065

USPC ..... 2/161.6, 161.7, 161.8, 164, 167

See application file for complete search history.

(56) References Cited

U.S. PATENT DOCUMENTS 3,026,531 A * 3/1962 Holaday ..... A41D 19/0065 2/167
3,173,150 A * 3/1965 Mohler ..... A41D 19/0006 2/167
3,268,355 A * 8/1966 Brodeur, Jr. ..... B29C 41/14 2/167
3,363,265 A * 1/1968 Dummire ..... A41D 19/01529 156/279

(Continued)

FOREIGN PATENT DOCUMENTS

JP H492508 U 8/1992
JP 3081979 U 11/2001

(Continued)

OTHER PUBLICATIONS

"Modified Examples of Asahi Chemical Kabushiki Kaisha, Fusion, and [online]", Asahi Kasei, 2011, pp. 1-2. Retrieved from https://www.asahi-kasei.co.jp/fibers/fusion/variation.html. Accessed Mar. 15, 2021.

*Primary Examiner* — Jocelyn Bravo
(74) *Attorney, Agent, or Firm* — The Webb Law Firm

(57) ABSTRACT

A supporting glove includes a glove base element made of fiber material, a resin coating applied to at least a part of an outer surface of the glove base element, and an inner glove made of fiber material provided inside the glove base element, wherein a relational expression of $d_2<d_1$ is satisfied, where $d_1$ is a volume fraction of solid contents per unit volume of the glove base element, and $d_2$ is a volume fraction of solid contents per unit volume of the inner glove.

6 Claims, 6 Drawing Sheets

(56) References Cited

U.S. PATENT DOCUMENTS 3,789,555 A * 2/1974 Means ..... A41D 19/01594 2/167
4,070,713 A * 1/1978 Stockum ..... B29C 41/14 2/168
4,089,069 A * 5/1978 Vistins ..... A41D 13/04 156/280
4,143,109 A * 3/1979 Stockum ..... B29C 37/0067 264/112
4,454,611 A * 6/1984 Tschirch ..... A41D 19/01529 2/16
4,637,947 A * 1/1987 Maekawa ..... A41D 31/0038 428/68
4,662,006 A * 5/1987 Ross, Jr. ..... A41D 19/01 2/158
4,785,479 A * 11/1988 Watanabe ..... A41D 19/0055 2/163
5,019,096 A * 5/1991 Fox, Jr. ..... A61B 42/10 2/167
5,020,161 A * 6/1991 Lewis, Jr. ..... A41D 13/0005 2/159
5,123,119 A * 6/1992 Dube ..... A41D 19/001 2/168
5,549,924 A * 8/1996 Shlenker ..... A01N 25/10 128/844
5,649,326 A * 7/1997 Richard, Jr. ..... A61F 13/041 2/161.7
5,935,882 A * 8/1999 Fujita ..... A41D 19/01529 2/161.6
6,016,571 A * 1/2000 Guzman ..... A41D 19/0055 15/227
6,419,729 B1 * 7/2002 Duffy ..... B01D 39/163 55/385.6
6,641,879 B1 * 11/2003 Matsuura ..... B29C 37/0067 2/161.7
6,972,148 B2 * 12/2005 Janssen ..... A41D 19/0055 2/161.7
7,175,895 B2 * 2/2007 Janssen ..... A61B 42/10 2/161.7
7,455,863 B2 * 11/2008 Hamann ..... A61K 8/0208 2/161.7
8,110,266 B2 * 2/2012 Chen ..... A41D 19/0058 428/36.8
8,209,774 B2 * 7/2012 Baacke ..... A41D 19/01505 2/161.6
8,413,469 B2 * 4/2013 Lapp ..... D02G 3/442 2/16
9,003,569 B2 * 4/2015 Ramirez ..... A41D 19/01547 2/163
2001/0047535 A1 * 12/2001 Thompson ..... A41D 19/001 2/167
2002/0086603 A1 * 7/2002 Yu ..... A41D 31/0038 442/396
2003/0167555 A1 * 9/2003 Han ..... A41D 19/0006 2/161.6
2003/0200592 A1 * 10/2003 Fujihana ..... A41D 19/0065 2/161.6
2003/0221235 A1 * 12/2003 Lewis ..... A41D 19/01529 2/16
2004/0088776 A1 * 5/2004 Grilliot ..... A41D 19/01529 2/161.6
2004/0098786 A1 * 5/2004 Hottner ..... A41D 19/001 2/159
2004/0123374 A1 * 7/2004 Soerens ..... A41D 19/0058 2/161.6
2004/0244091 A1 * 12/2004 Parren ..... F16P 3/12 2/161.6
2005/0050619 A1 * 3/2005 Dunn ..... A41D 31/0027 2/458
2005/0106201 A1 * 5/2005 Janssen ..... A61B 42/10 424/402
2005/0172655 A1 * 8/2005 Naaman ..... A41D 13/0025 62/259.3
2005/0268374 A1 * 12/2005 Mattesky ..... A41D 19/01523 2/164
2006/0117457 A1 * 6/2006 Williams ..... A41D 19/0006 2/164
2006/0130212 A1 * 6/2006 Kishihara ..... A41D 19/0055 2/161.6
2006/0156451 A1 * 7/2006 Klein ..... A41D 19/001 2/159
2006/0205307 A1 * 9/2006 Drouin ..... A41D 31/0038 442/328
2007/0083980 A1 * 4/2007 Yang ..... A41D 19/0006 2/167
2008/0134412 A1 * 6/2008 Lapp ..... A41D 19/01505 2/161.8
2009/0038051 A1 * 2/2009 Fujihana ..... A41D 19/01558 2/161.8
2009/0055992 A1 * 3/2009 Thompson ..... A41D 19/001 2/164
2009/0183298 A1 * 7/2009 Baacke ..... A41D 19/0058 2/167
2009/0222980 A1 * 9/2009 Klug ..... A41D 19/001 2/455
2010/0005562 A1 * 1/2010 Park ..... A41D 19/0024 2/160
2011/0041236 A1 * 2/2011 Higuchi ..... A41D 19/0065 2/167
2011/0083249 A1 * 4/2011 Wochner ..... A41D 19/0006 2/161.6
2011/0179549 A1 * 7/2011 Zaggl ..... A41D 19/01547 2/93
2011/0265246 A1 * 11/2011 Saito ..... A41D 19/0065 2/168
2012/0260422 A1 * 10/2012 Rock ..... A41D 31/0038 5/483
2013/0067706 A1 * 3/2013 Fung ..... D04H 18/02 28/115
2013/0086732 A1 * 4/2013 Hofmeister ..... A41D 19/0068 2/161.6
2013/0139294 A1 * 6/2013 Zetune ..... A41D 19/01505 2/163
2013/0196109 A1 * 8/2013 Rock ..... A41D 31/0038 428/76
2013/0219588 A1 * 8/2013 Nakagawa ..... A41D 19/01558 2/168
2013/0232662 A1 * 9/2013 Williams ..... A41D 19/001 2/164
2013/0281234 A1 * 10/2013 Ramirez ..... A41D 27/28 473/415
2014/0059739 A1 * 3/2014 Gellis ..... A41D 19/015 2/168
2014/0115750 A1 * 5/2014 Kassam ..... B29C 41/14 2/159
2014/0237701 A1 * 8/2014 Thompson ..... A41D 19/001 2/164
2015/0033801 A1 * 2/2015 Finzelberg ..... B29C 41/14 66/174
2015/0121598 A1 * 5/2015 Mathews ..... A41D 19/01529 2/16
2015/0135403 A1 * 5/2015 Mercado ..... C09D 109/02 2/164
2015/0143609 A1 * 5/2015 Francisco Costa ..... A41D 19/01547 2/167
2015/0374052 A1 * 12/2015 Pimentel de Oliveira ..... A41D 19/0006 2/161.6
2016/0029725 A1 * 2/2016 Dee ..... A41D 31/0038 2/85
2016/0108564 A1 * 4/2016 Topolkaraev ..... D01D 5/247 442/194
2016/0192721 A1 7/2016 Kishihara
2016/0286874 A1 * 10/2016 Kishihara ..... A41D 19/0006

(56) References Cited

U.S. PATENT DOCUMENTS

| | | | | |
|---|---|---|---|---|
| 2017/0210916 | A1* | 7/2017 | Uotani | B05D 5/00 |
| 2017/0280802 | A1* | 10/2017 | Park | A41H 41/00 |

FOREIGN PATENT DOCUMENTS

| | | | |
|---|---|---|---|
| JP | 2004107813 | A | 4/2004 |
| JP | 2011122261 | A | 6/2011 |
| JP | 201367879 | A | 4/2013 |
| JP | 3192665 | U | 8/2014 |
| JP | 3195540 | U | 1/2015 |
| WO | 2015008545 | A1 | 1/2015 |
| WO | 2015074106 | A1 | 5/2015 |

* cited by examiner

SUPPORTING GLOVE AND METHOD FOR MANUFACTURING THE SUPPORTING GLOVE

CROSS-REFERENCE TO RELATED APPLICATION

This application claims priority to Japanese Patent Application No. 2015-235871, filed Dec. 2, 2015, the disclosure of which is incorporated herein by reference in its entirety.

BACKGROUND OF THE INVENTION

Field of the Invention

The present invention relates to a supporting glove and a method for manufacturing the supporting glove.

Background Art

Conventionally, there is known a supporting glove including a glove base element made of fiber material, and a resin coating applied to at least a part of an outer surface of the glove base element (e.g. Japanese Patent Laid-Open No. 2004-107813). In this kind of supporting glove, the resin coating causes the glove to increase in strength. In addition, in this kind of supporting glove, the resin coating enables foreign material such as dirt and dust to be prevented from entering voids between fibers of the glove base element made of the fiber material.

In this kind of supporting glove, from the viewpoint of keeping warmth, it is preferable to sufficiently hold air with low thermal conductivity in voids between fibers of the glove base element. Thus, it is preferable that a volume fraction of solid contents per unit volume be small in the glove base element.

However, if the volume fraction of solid contents per unit volume is reduced without changing the glove base element in thickness, when coating liquid containing resin is applied to an outer surface of the glove base element to form a resin coating, the coating liquid may enter voids between fibers of the glove base element to reduce the voids between the fibers. This may contrarily cause deterioration in keeping warmth.

In addition, a manner of increasing thickness of the glove base element or the resin coating may also be considered. However, if the supporting glove increases in thickness, flexibility thereof is deteriorated to cause a problem in which tactile feeling when an object is held does not easily reach the hands of the wearer.

In light of the problem described above, the present invention has an object to provide a supporting glove and a method for manufacturing the supporting glove that is relatively excellent in keeping warmth and flexibility, and that allows tactile feeling when an object is held to easily reach the hands of the wearer.

SUMMARY OF THE INVENTION

A supporting glove according to the present invention includes a glove base element made of fiber material, a resin coating applied to at least a part of an outer surface of the glove base element, and an inner glove made of fiber material provided inside the glove base element, wherein a relational expression of $d_2<d_1$ is satisfied where $d_1$ is a volume fraction of solid contents per unit volume of the glove base element, and $d_2$ is a volume fraction of solid contents per unit volume of the inner glove.

In the supporting glove above, the resin coating may be a foamed coating containing air cells.

In the supporting glove, at least a part of an outer surface of the inner glove and at least a part of an inner surface of the glove base element may be bonded to each other.

In the supporting glove in which the at least a part of an outer surface of the inner glove and the at least a part of an inner surface of the glove base element are bonded to each other, a cuff of the inner glove and a cuff of the glove base element are bonded to each other as well as fingertips of the inner glove and corresponding fingertips of the glove base element are bonded to each other, and on a dorsal side, portions corresponding to first joints and second joints of fingers in finger members of the inner glove, and portions corresponding to the first joints and the second joints thereof in finger members of the glove base element, may not be bonded to each other.

A method for manufacturing a supporting glove according to the present invention is for the supporting glove including a glove base element made of fiber material, and a resin coating applied to at least a part of an outer surface of the glove base element, and the method includes the steps of a resin coating forming step of applying coating liquid containing resin for forming the resin coating to at least a part of an outer surface of the glove base element to form the resin coating; and an inner glove disposing step of disposing an inner glove inside the glove base element, the inner glove having a volume fraction of solid contents per unit volume that is less than a volume fraction of solid contents per unit volume of the glove base element.

In the method above of manufacturing the supporting glove, the coating liquid may be foamed.

In addition, in the method above of manufacturing the supporting glove, at least a part of an outer surface of the inner glove and at least a part of an inner surface of the glove base element may be bonded to each other in the inner glove disposing step.

Further, in the method above of manufacturing the supporting glove in which the at least a part of the outer surface of the inner glove and the at least a part of the inner surface of the glove base element are bonded to each other in the inner glove disposing step, a cuff of the inner glove and a cuff of the glove base element are bonded to each other as well as fingertips of the inner glove and corresponding fingertips of the glove base element are bonded to each other, and on a dorsal side, portions corresponding to first joints and second joints of fingers in finger members of the inner glove, and portions corresponding to the first joints and the second joints thereof in finger members of the glove base element, may not be bonded to each other.

DETAILED DESCRIPTION OF THE PREFERRED EMBODIMENTS

Figure 1A:
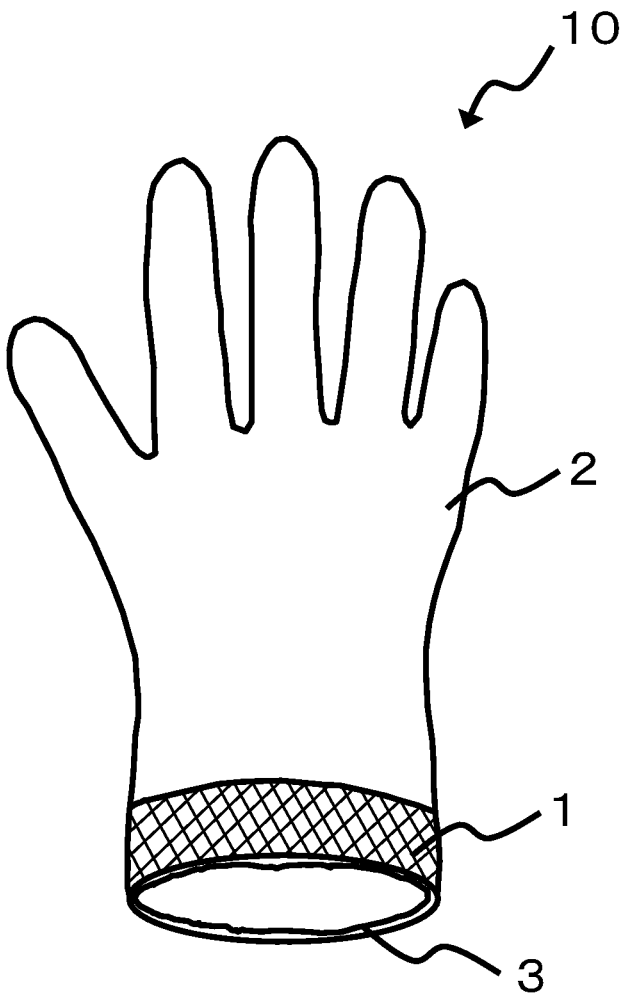
FIG. 1A illustrates a supporting glove according to a first embodiment of the present invention viewed from a dorsal side.

First, a supporting glove 10 according to a first embodiment of the present invention will be described with reference to FIGS. 1A and 1B.

The supporting glove 10 according to the present embodiment includes a glove base element 1 made of fiber material, a resin coating (first resin coating 2) applied to at least a part of an outer surface of the glove base element 1, and an inner glove 3 made of fiber material provided inside the glove base element 1, wherein a relational expression of $d_2<d_1$ is satisfied where $d_1$ is a volume fraction of solid contents per unit volume of the glove base element 1, and $d_2$ is a volume fraction of solid contents per unit volume of the inner glove 3.

The glove base element 1 is a glove made of fiber, acquired by knitting fiber material into a glove-like shape. The glove base element 1 includes a body section formed in a pouch-like shape so as to envelop the palm of the wearer, an extended section extended from the body section so as to envelop the fingers of the wearer, and a cuff formed in a cylindrical shape so as to envelop the wrist of the wearer, the cuff extending from the body section in a direction opposite to the extended section. The extended section includes a thumb member, an index finger member, a middle finger member, a third finger member, and a little finger member that receive respectively the thumb, the index finger, the middle finger, the third finger, and the little finger of the wearer. Each of the thumb member to the little finger member is formed in a cylindrical shape, and has a closed fingertip. The cuff has an opening through which the wearer can insert their hand into the glove.

The glove base element 1 is formed by using various kinds of publicly known general-purpose fiber such as nylon fiber, polyester fiber, polyethylene fiber, cotton, acrylic fiber, rayon fiber, or various kinds of publicly known cut-resistant fiber such as ultra-high molecular weight polyethylene fiber, aramid fiber, glass fiber, and stainless steel fiber, or fiber material such as composite yarn of the various kinds of fiber above.

The glove base element 1 is formed by knitting fiber material into a glove shape by using a glove knitting machine, for example, or is formed by cutting out a knitted fabric into an appropriate shape, the knitted fabric being formed by kitting fiber material with a circular knitting machine, a flat-knitting machine, or a warp knitting machine, so that the cut knitted fabrics are sewn into a glove shape.

In general, since increase in thickness of a glove deteriorates flexibility, tactile feeling when the wearer holds an object cannot easily reach the hand. Thus, when a glove knitting machine is used, it is preferable to select a 10-gauge or more glove knitting machine. In consideration of ease of knitting process, it is more preferable to select one of 13-gauge to 18-gauge glove knitting machines.

It is preferable that the glove base element 1 has a thickness of not less than 0.20 mm and not more than 0.80 mm. A thickness of 0.20 mm or more enables sufficient strength to be maintained. A thickness of 0.80 mm or less reduces deterioration in flexibility to enable tactile feeling when the wearer holds an object to easily reach the hand of the wearer. Thickness of the glove base element 1 is measured by using a constant pressure thickness gauge (TECLOCK Corp., Model No. PG-15) under conditions where a pressurized load is 2.35 N, and a diameter of a probe is ϕ11.3 mm, with no tension of stretching applied.

It is preferable that the volume fraction of solid contents per unit volume ($d_1$) of the glove base element 1 is not less than 15 volume % and not more than 50 volume %. A $d_1$ of 15 volume % or more enables sufficient strength to be maintained. A $d_1$ of 50 volume % or less enables sufficient air to be held in voids between fibers. A lower limit value of the $d_1$ is preferably 20 volume % or more, more preferably 21.5 volume %, and is optimally 25 volume % or more. An upper limit value of the $d_1$ is preferably 40 volume % or less, and is more preferably 30 volume % or less. The $d_1$ is calculated from thickness measured as described above, weight of the glove base element 1 per unit area, and specific gravity of fiber material forming the glove base element 1. The specific gravity of fiber material is measured in accordance with JIS L 1013, 2010 of a method of testing chemical fiber filament yarn. Fiber material with a larger specific gravity that cannot be measured in accordance with JIS L 1013, 2010 is measured in accordance with JIS Z 8807, 2012, of a method of measuring density and specific gravity of a solid.

Figure 1B:
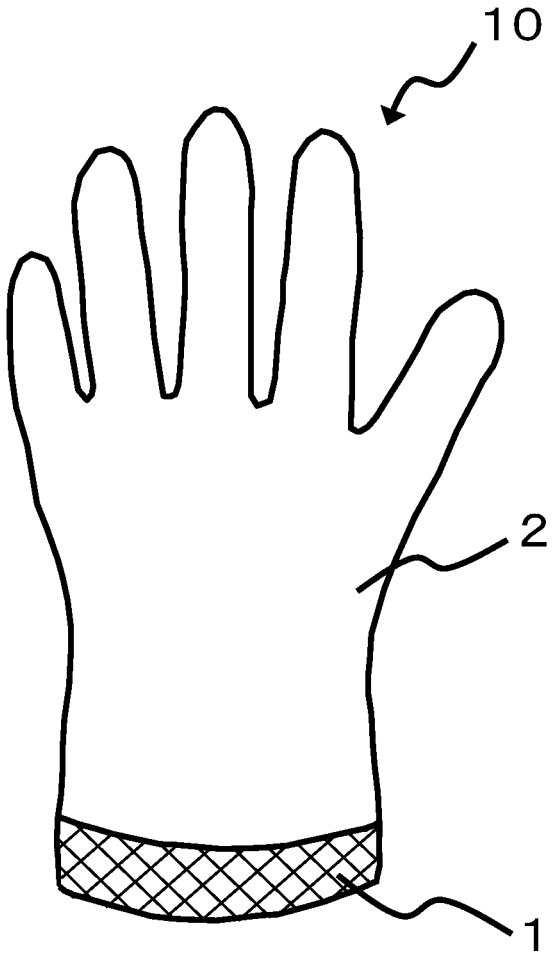
FIG. 1B illustrates the supporting glove according to the first embodiment of the present invention viewed from a palm side.

The first resin coating 2 is formed of resin used as a material, and includes portions other than the cuff of the glove base element 1 on a palm side and a dorsal side of the glove base element 1, namely the body section and the extended section, as illustrated in FIGS. 1A and 1B, for example. As the resin, there are available various kinds of publicly known resin, such as vinyl chloride resin, natural rubber, nitrile-butadiene rubber, chloroprene rubber, fluorocarbon rubber, silicone rubber, isoprene rubber, polyurethane, acrylic resin, and modification of them (e.g. carboxyl modification). Alternatively, the various kinds of publicly known resin also can be used in combination with each other.

The various kinds of publicly known resin may be formulated with an add-in material in general use, including a vulcanizing agent such as sulfur, a vulcanizing accelerator such as zinc dimethyldithiocarbamate, a vulcanizing supplement accelerator such as zinc oxide, a crosslinking agent such as blocked isocyanate, a plasticizer and a softening agent, such as mineral oil and phthalate ester, an antioxidant and an age resister, such as 2,6-di-t-butyl-4-methyl phenol, a thickener such as acrylic polymer and polysaccharide, a foaming agent such as azodicarbonamide, a frothing agent and a foam stabilizer, such as sodium stearate, and an anti-tackiness agent such as paraffin wax, and with fillers in general use, such as carbon black, calcium carbonate, and pulverizing silica. The first resin coating 2 is usually formed with a thickness of 0.2 to 2.0 mm. The thickness of the first resin coating 2 is acquired by arithmetically averaging measurement values that are acquired by measuring height of 20 points randomly selected at intervals at least 2 mm of a cross section of the first resin coating 2 in a direction oblique to a knitting (weaving) direction of the glove base element 1, using a digital microscope (Keyence Corp., model No. VHX-900), while the points are observed at 100-fold magnification, for example. The random 20 points exclude a thin portion at a rim of the first resin coating 2 and an extremely thick portion caused by an unintended resin flow.

The first resin coating 2 is preferably a foamed coating containing air cells from the viewpoint of flexibility and a capability of increasing an amount of air to be held. A volume fraction of solid contents per unit volume of the first resin coating 2 is preferably not less than 30 volume % and not more than 90 volume %. A volume fraction of 30 volume % or more enables the first resin coating 2 to be formed with sufficient strength. A volume fraction of 90 volume % or less enables sufficient flexibility to be acquired, as well as a sufficient amount of air to be held. A lower limit value of the volume fraction described above is preferably 40 volume % or more, and is more preferably 50 volume % or more. An upper limit value of the volume fraction described above is preferably 85 volume % or less, and is more preferably 80 volume % or less.

The volume fraction of solid contents per unit volume of the first resin coating 2 is preferably more than the volume fraction of solid contents per unit volume of the glove base element 1. This enables the strength of the supporting glove to be maintained, while an amount of air that can be held to be increased.

The volume fraction described above can be acquired by the following method. First, while any cross section of the first resin coating 2 in a direction oblique to the knitting (weaving) direction of the glove base element 1 is observed at 100-fold magnification, for example, using the digital microscope (Keyence Corp., model No. VHX-900), a starting point is set on the first resin coating 2. Next, with respect to a cross section area of the first resin coating 2, defined within a distance of 3 mm in a direction orthogonal to a thickness direction of the first resin coating 2 from the starting point, a volume fraction is calculated from an area of the cross section area and an area of voids included in the cross section area. This calculation is performed at five places in the direction orthogonal to the thickness direction of the first resin coating 2, and the volume fraction described above is acquired by arithmetically averaging the calculation values.

It is preferable that the first resin coating 2 penetrates partially into voids between fibers of the glove base element 1 from the viewpoint of air that is held in the voids between fibers of the glove base element 1. It is preferable that a penetration ratio of the first resin coating 2 with respect to thickness of the glove base element 1 is not less than 5% and not more than 75%. A penetration ratio of 5% or more enables adhesive strength of the first resin coating 2 to the glove base element 1 to be secured. A penetration ratio of 75% or less enables flexibility and voids between fibers of the glove base element 1 to be secured. A lower limit value of the penetration ratio described above is preferably 10% or more, and is more preferably 20% or more. An upper limit value of the penetration ratio described above is preferably 70% or less, and is more preferably 60% or less.

The penetration ratio described above is acquired by dividing thickness of the first resin coating 2 penetrating into the glove base element 1 by thickness of the glove base element 1 when the first resin coating 2 is penetrated.

Figure 1C:
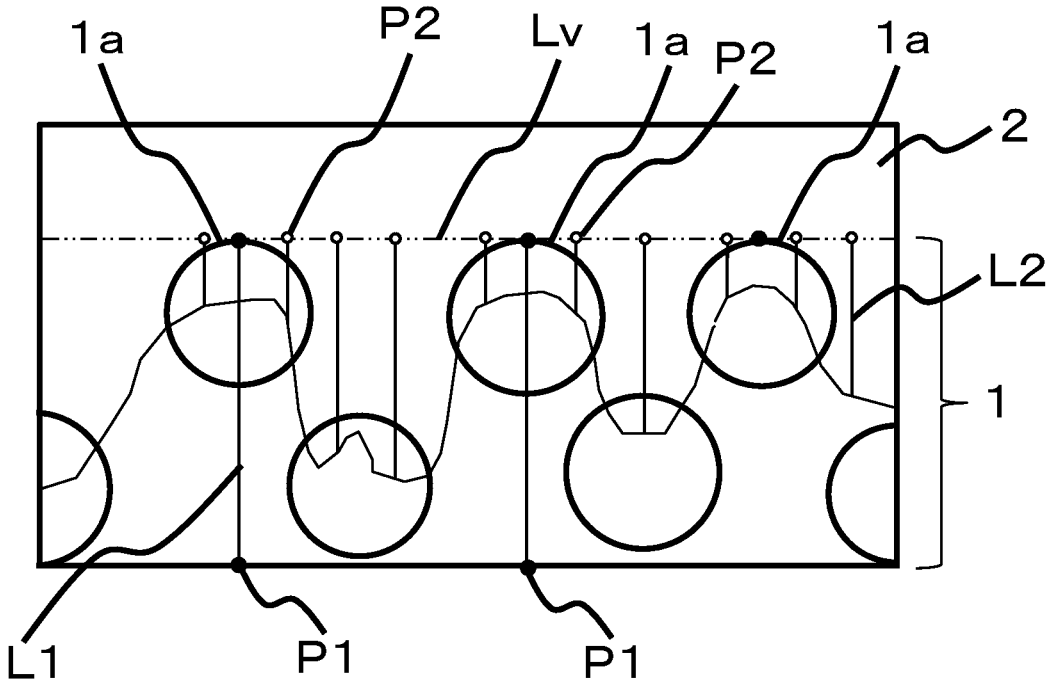
FIG. 1C illustrates an explanatory view for a method for measuring the thickness of a glove base element and the thickness of a first resin coating penetrating into the glove base element, of the supporting glove according to the first embodiment of the present invention.

The thickness of the glove base element 1 when the first resin coating 2 is penetrated is acquired by the following method. First, while any cross section in a direction oblique to a knitting (weaving) direction of the glove base element 1 into which the first resin coating 2 penetrates is observed at 50-fold magnification, for example, using the digital microscope (Keyence Corp., model No. VHX-900), a starting point is set in the cross section. Next, there is set a cross section area defined within a distance of 6 mm in a direction orthogonal to the thickness direction of the glove base element 1 from the starting point (see FIG. 1C). In the cross section area, at least two raised portions 1*a* (a fiber bundle used in knitting or weaving) of the glove base element 1 on a side being in contact with the first resin coating 2 are selected, and a first perpendicular L1 is drawn toward an edge face of the glove base element 1 on a side without being in contact with first resin coating 2 (the side opposite to the first resin coating 2) from an apex of each of the raised portions 1*a*, and then a point (first orthogonal point P1) at which the edge face and each of the first perpendiculars L1 intersect with each other is acquired. Subsequently, a distance from the apex of each of the raised portions 1*a* to each corresponding one of the first orthogonal points P1 is measured. The thickness of the glove base element 1 when the first resin coating 2 is penetrated is acquired by arithmetically averaging the measurement values.

The thickness of the first resin coating 2 penetrating into the glove base element 1 is acquired by the following method. The apexes of the raised portions 1*a* are connected to each other by a virtual line Lv, respectively. Next, ten points are randomly selected in a rim of the first resin coating 2 on a glove base element 1 side, and second perpendiculars L2 are respectively drawn toward the virtual line Lv from the points, and then points (second orthogonal points P2) at each of which the virtual line Lv and each of the second perpendiculars L2 intersect with each other is acquired. Subsequently, each distance from the rim of the first resin coating 2 to each of the second orthogonal points P2 is measured, and the thickness of the first resin coating 2 penetrating into the glove base element 1 is acquired by arithmetically averaging the measurement values.

The penetration ratio is calculated at five places in a direction orthogonal to the thickness direction of the glove base element 1, and is acquired by arithmetically averaging the calculation values.

The inner glove 3 is a fiber glove formed by knitting fiber material into a glove-like shape as with the glove base element 1, and has a structure similar to that of the glove base element 1. The fiber material includes various kinds of publicly known general-purpose fiber or cut-resistant fiber, and composite yarn of the various kinds of publicly known fiber. As the fiber material, bulky finished yarn formed by a woolly finish, differential shrinkage combined filament yarn, and fancy yarn, are preferable. These fiber materials reduce a volume fraction of solid contents per unit volume of the inner glove 3 to increase an amount of air to be held in voids between fibers of the inner glove 3, thereby enabling increase in keeping warmth of a glove. Meanwhile, glass fiber and stainless steel fiber are unfavorable as the fiber material. These fiber materials cause deterioration in keeping warmth due to their high thermal conductivity. Specific gravity of the fiber material can be acquired as with specific gravity of the fiber material of the glove base element 1.

The inner glove 3 is formed as with the glove base element 1. For example, when the inner glove 3 is formed by using a glove knitting machine, it is preferable to select a 13-gauge or less glove knitting machine to increase an amount of air that can be held in voids between fibers of the inner glove 3, from the viewpoint of increase in keeping warmth. In consideration of ease of knitting process, it is preferable to select one of 5-gauge to 10-gauge glove knitting machines. From the viewpoint of increase in keeping warmth, nap-raising treatment may be applied to the inner glove 3.

It is preferable that the inner glove 3 have a thickness of not less than 0.5 mm and not more than 3.0 mm. A thickness of 0.5 mm or more enables sufficient strength to be maintained. A thickness of 3.0 mm or less reduces deterioration in flexibility to enable tactile feeling when the wearer holds an object to easily reach the hand of the wearer.

Thickness of the inner glove 3, as with thickness of the glove base element 1, is measured by using the constant pressure thickness gauge (TECLOCK Corp., Model No. PG-15) under conditions where a pressurized load is 2.35 N, and a diameter of the probe is ϕ11.3 mm, with no tension of stretching applied.

It is preferable that the volume fraction of solid contents per unit volume ($d_2$) of the inner glove 3 is not less than 10 volume % and not more than 30 volume %. A $d_2$ of 10 volume % or more prevents the inner glove 3 from twisting to enable capability of keeping warmth to be prevented from partially deteriorating due to a twist. A $d_2$ of 30 volume % or less enables sufficient flexibility of the supporting glove to be maintained, as well as enables increase in an amount of air that can be held in voids between fibers of the inner glove 3, thereby enabling improvement in keeping warmth. A lower limit value of the $d_2$ is preferably 15 volume % or more, and is more preferably 17 volume % or more. An upper limit value of the $d_2$ is preferably 26 volume % or less, and is more preferably 24 volume % or less. A value of $d_2$ is set so as to be less than a value of $d_1$. This allows sufficient air to be held in voids between fibers of the inner glove 3, thereby enabling increase in keeping warmth. A value of $d_2$ is calculated as with the glove base element 1. A value of $d_2$ is acquired as with the value of $d_1$.

It is preferable that the inner glove 3 and the glove base element 1 be formed integrally with each other. For example, the inner glove 3 and the glove base element 1 may be formed integrally with each other by sewing the cuff of the glove base element 1 and the cuff of the inner glove 3 together with a thread, or by bonding at least a part of an inner surface of the glove base element 1, and at least a part of an outer surface of the inner glove 3, to each other with adhesive. Alternatively, the inner glove 3 and the glove base element 1 may be formed integrally with each other by combination of sewing with a thread and bonding with adhesive. This enables the inner glove 3 to be prevented from coming out from the glove base element 1 by following movement of the hand of the wearer when the glove is removed.

When at least a part of the inner surface of the glove base element 1, and at least a part of the outer surface of the inner glove 3, are bonded to each other, it is preferable that the cuff of the inner glove 3 and the cuff of the glove base element 1 be bonded to each other as well as fingertips of the inner glove 3 and corresponding fingertips of the glove base element 1 are bonded to each other, and on a dorsal side, portions corresponding to first joints and second joints of fingers in finger members of the inner glove 3, and corresponding portions corresponding to the first joints and the second joints thereof in finger members of the glove base element 1, may not be bonded to each other. In addition, it is preferable that the fingertips of the inner glove 3 and the corresponding fingertips of the glove base element 1 be bonded to each other both on the dorsal side and on the palm side, or be bonded to each other on any one of the sides. This enables reduction in stretched feeling when the wearer moves their fingers. As the adhesive, publicly known adhesives are available.

Figure 2A:
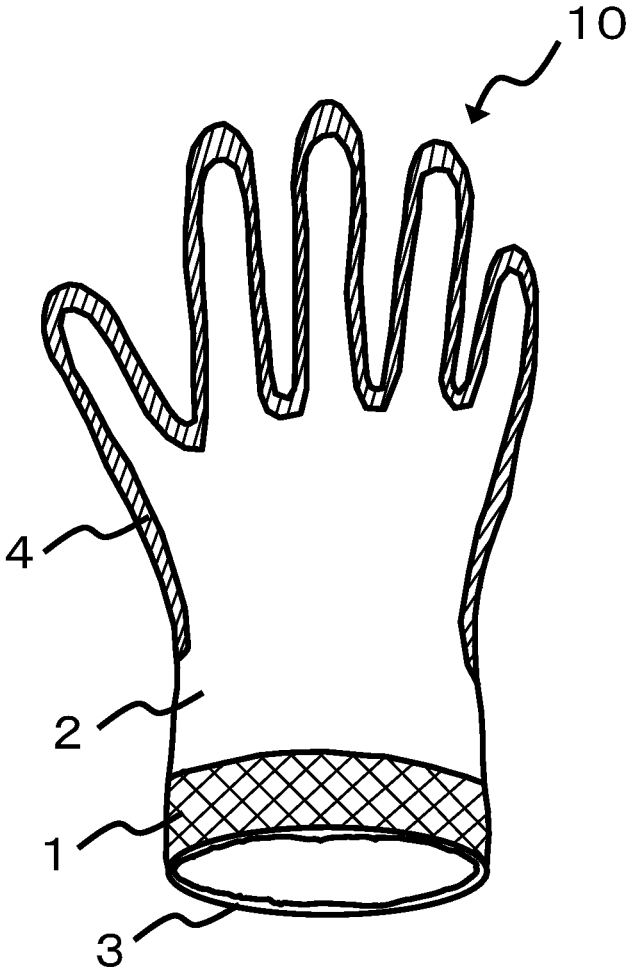
FIG. 2A illustrates a supporting glove according to a second embodiment of the present invention viewed from a dorsal side.
Figure 2B:
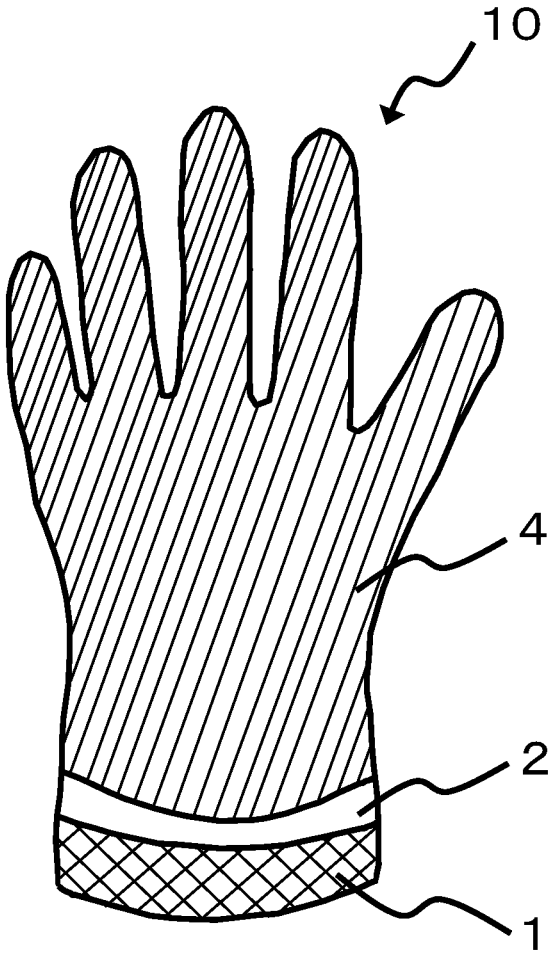
FIG. 2B illustrates the supporting glove according to the second embodiment of the present invention viewed from a palm side.

Next, the supporting glove 10 according to a second embodiment will be described with reference to FIG. 2.

The supporting glove 10 according to this embodiment includes a second resin coating 4 with which at least a part of an outer surface of the first resin coating 2 is covered, and that has strength greater than that of the first resin coating 2. The second resin coating 4 is formed of resin as material, as with the first resin coating 2, and is formed in a portion of the supporting glove 10 where strength needs to further increase, such as the fingertips on the dorsal side, a side surface of each of the finger members, and a part of the body section on the palm side, and the extended section.

The second resin coating 4 may be formed of material similar to that of the first resin coating 2, or may be formed of material different from that of the first resin coating 2. When material different from that of the first resin coating 2 is used for the second resin coating 4, an adhesive layer may be provided between the first resin coating 2 and the second resin coating 4, from the viewpoint of increasing bonding performance. The adhesive layer is formed by using various kinds of publicly known adhesive, such as an acrylic-based adhesive and a urethane-based adhesive. The adhesive preferably has a solubility parameter (SP value) between an SP value of material of the first resin coating 2 and an SP value of material of the second resin coating 4. The second resin coating 4 is usually formed with a thickness of 0.1 to 2.0 mm. The thickness of the second resin coating 4 is measured as with that of the first resin coating 2.

The second resin coating 4 is formed as a nonporous resin coating. Accordingly, strength increases. In the present specification, a nonporous resin coating means that no void is observed by a visual check when a cross section of the coating is observed at 100-fold magnification by using the digital microscope (Keyence Corp., model No. VHX-900). However, a void caused by an unintended air cell is neglected.

The second resin coating 4 may be formed as a foamed coating with a volume fraction of solid contents per unit volume more than that of the first resin coating 2. This enables increase in keeping warmth.

In addition, the second resin coating 4 may be formed by using at least one kind of resin selected from among natural rubber, nitrile-butadiene rubber, chloroprene rubber, isoprene rubber, fluorocarbon rubber, silicone rubber, vinyl chloride resin, polyurethane, acrylic resin, and modification of them. This improves anti-slip performance to achieve excellent grip force. Alternatively, the second resin coating 4 may be formed by using resin to which anti-slip particles are added.

The second resin coating 4 may be formed by using moisture permeable polyurethane. This improves permeability to reduce humidity in the glove.

A volume fraction ($d_3$) of solid contents per unit volume of the second resin coating 4 is preferably not less than 70 volume % and not more than 100 volume %. A volume fraction of 70 volume % or more enables the second resin coating 4 to be formed with sufficient strength. A value of $d_3$ can be acquired as with the volume fraction of solid contents per unit volume of the first resin coating 2.

The volume fraction of solid contents per unit volume of the second resin coating 4 is preferably more than the volume fraction of solid contents per unit volume of the first resin coating 2. This causes improvement in flexibility, keeping warmth, and durability.

The second resin coating 4 can randomly include asperities by treating the second resin coating 4 with a swelling liquid, spraying deliquescent particles on the second resin coating 4 before dried and removing the particles after the coating is dried, and the like, other than adding anti-slip particles to resin as described above. This preferably reduces a contact area between an object and the second resin coating 4 when the object is held, thereby reducing heat to be transferred.

The liquid swelling the second resin coating 4 can be appropriately selected depending on a kind of resin forming the second resin coating 4.

The volume fraction of solid contents per unit volume of the second resin coating 4 also can be acquired as with the volume fraction of solid contents per unit volume of the first resin coating 2.

Figure 3:
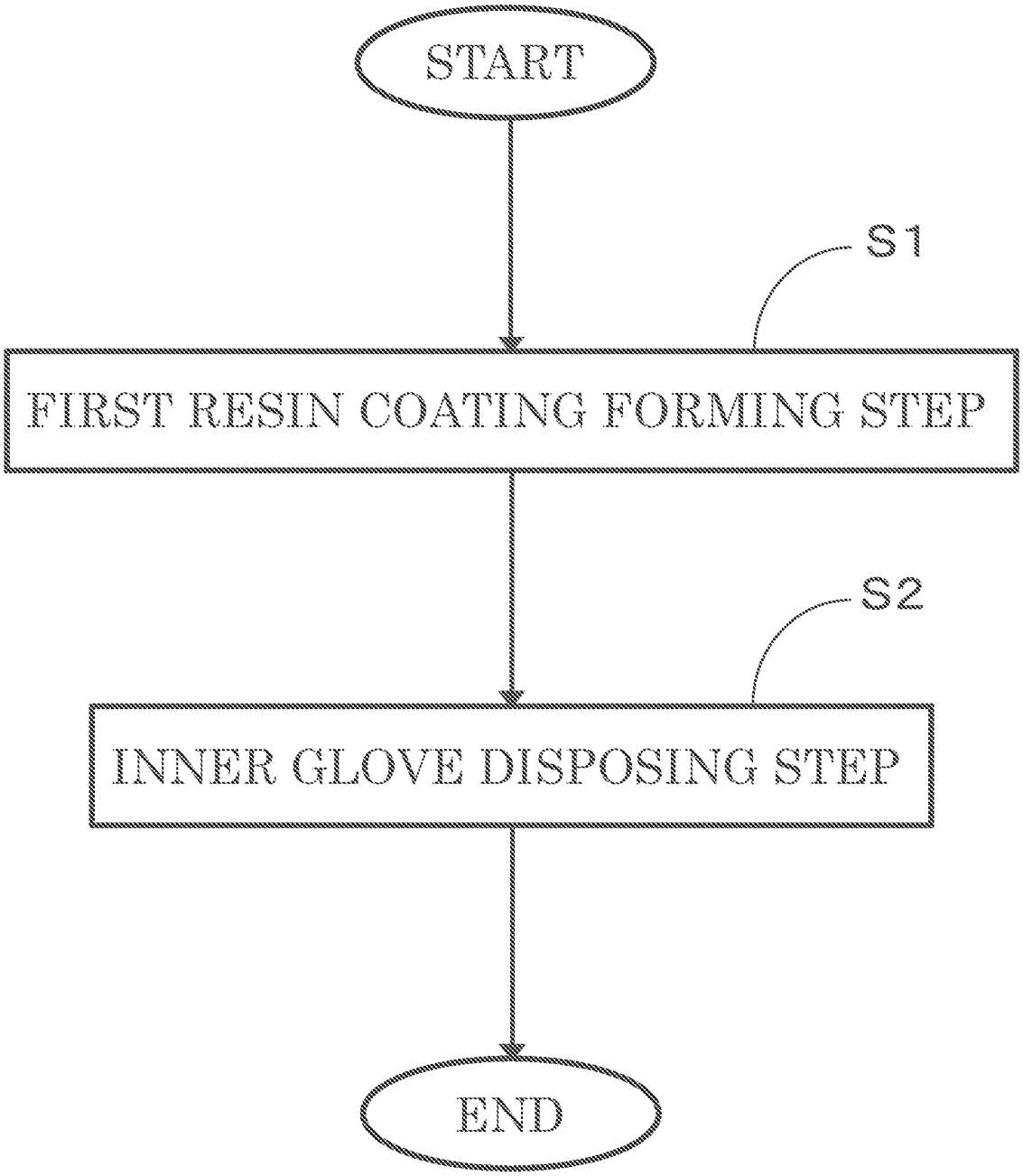
FIG. 3 is a flow chart illustrating a method for manufacturing the supporting glove according to the first embodiment of the present invention.

Next, a method for manufacturing the supporting glove 10 according to the first embodiment of the present invention will be described with reference to FIG. 3.

A method for manufacturing the supporting glove 10 according to the present embodiment is a method for manufacturing the supporting glove 10 including the glove base element 1 made of fiber material, and a resin coating (first resin coating 2) applied to at least a part of an outer surface of the glove base element 1, and the method includes the steps of applying coating liquid containing resin for forming the resin coating (first resin coating 2) to at least a part of an outer surface of the glove base element 1 to form the resin coating (first resin coating 2) (first resin coating forming step); and disposing the inner glove 3 inside the glove base element 1, the inner glove 3 having a volume fraction of solid contents per unit volume that is less than a volume fraction of solid contents per unit volume of the glove base element 1.

(First Resin Coating Forming Step: S1)

In the present step, a first coating liquid containing resin to form the first resin coating 2 is applied to at least a part of an outer surface of the glove base element 1 put on a hand model. The hand model is one of various kinds of publicly known hand model made of ceramic, metal, or the like.

The first coating liquid contains resin. The resin includes the various kinds of publicly known resin described before. A suitable resin can be used from among the various kinds of publicly known resin depending on purpose. For example, when the first resin coating 2 is intended to be improved in strength and ease of processing, it is preferable to use latex such as natural rubber and nitrile-butadiene rubber. In this case, the first coating liquid is prepared to have a ratio of solid contents of 20 to 60 mass %. The ratio of solid contents is adjusted by using water and the like. The first coating liquid may contain colloidal sulfur. When latex is used as resin of the first coating liquid, it is preferable that 0.1 to 2.0 parts by mass of the colloidal sulfur be contained with respect to 100 parts by mass of solid contents of the latex. In addition, the first coating liquid may contain a vulcanizing accelerator. The vulcanizing accelerator includes zinc dibutyldithiocarbamate, zinc diethyldithiocarbamate, zinc dibenzyldithiocarbamate, and tetramethylthiuram monosulphide. When latex is used as resin of the first coating liquid, it is preferable that 0.1 to 2.0 parts by mass of the vulcanizing accelerator is contained with respect to 100 parts by mass of solid contents of the latex. The first coating liquid may contain zinc oxide. When latex is used as resin of the first coating liquid, it is preferable that 0.1 to 2.0 parts by mass of the zinc oxide be contained with respect to 100 parts by mass of solid contents of the latex. The first coating liquid also may contain a thickener. The thickener includes a cellulosic thickener, an acrylic polymer, and a silica-based thickener. Thickener content is appropriately adjusted in accordance with a target viscosity.

Viscosity of the first coating liquid is preferably 1000 to 4000 mPa·s when measured under a condition of V6 by using a B-type viscometer.

The first coating liquid is preferably foamed from the viewpoint of increasing flexibility of the first resin coating 2 and an amount of air that can be held in the first resin coating 2. It is more preferable to foam the first coating liquid so that a volume fraction of solid contents of the first resin coating 2 is more than a volume fraction of solid contents of the glove base element 1. The first coating liquid can be foamed by any one of machine foaming and chemical foaming.

When the machine foaming is used, the first coating liquid is stirred with an electric whisk or the like, so that a volume fraction of air cells in the first coating liquid becomes a desired value. In addition, when the machine foaming is used, the first coating liquid may contain a frothing agent and a foam stabilizer. As the frothing agent, there are available disodium N-octadecyl sulfosuccinamate, N-tallow alkyl sulfosuccinamic acid disodium, potassium oleate, castor oil potassium salt, sodium dodecylbenzenesulfonate, and the like. As the foam stabilizer, there are available ammonium stearate, peptide, alkyl imino dipropionic acid sodium salt, and the like. Each of the frothing agent and the foam stabilizer can be appropriately used with 8 parts by mass or less with respect to 100 parts by mass of solid contents of the first coating liquid.

When the chemical foaming is used, a predetermined amount of various kinds of publicly known chemical foaming agent such as azodicarbonamide, N/N'-dinitrosopentamethylenetetramine, and a thermally expandable microcapsule, for example, is added into the first coating liquid so that a volume fraction of air cells in the first coating becomes a desired value.

In consideration of ease of foaming, and capability of improvement in air permeability by allowing air cells to communicate with each other, for example, it is preferable to use machine foaming. Since the machine foaming increases viscosity, viscosity of the first coating liquid is preferably 1000 to 4000 mPa·s when measured under the condition of V6 by using the B-type viscometer after the first coating liquid is foamed.

In the case of machine foaming, a volume fraction of bubbles in the first coating liquid is preferably not less than 5 volume % and not more than 60 volume %. A volume fraction of 5 volume % or more enables flexibility of the first resin coating 2 and an amount of air that can be held to be sufficiently maintained. A volume fraction of 60 volume % or less enables deterioration in strength of the first resin coating 2 to be reduced. A lower limit value of the volume fraction of bubbles in the first coating liquid is more preferably 10 volume % or more, and is further preferably 15 volume % or more. An upper limit value of the volume fraction is preferably 50 volume % or less, and is more preferably 40 volume % or less. The volume fraction of bubbles in the first coating liquid can be acquired from a volume of the coating liquid before it is foamed, and a volume of the coating liquid containing bubbles after it is foamed.

As a technique of applying the first coating liquid, while various kinds of publicly known coating technique such as shower coating and dip coating can be used, it is preferable to use the dip coating from the viewpoint of facilitating stable and uniform application of a coating liquid. The dip coating can be performed as follows: dipping an outer surface of the glove base element 1 on which the first resin coating 2 is to be formed, in the first coating liquid that is previously stored in a tank, for a predetermined time; and then withdrawing the glove base element 1 from the first coating liquid.

From the viewpoint of preventing the first coating liquid from penetrating into deep portions in voids between fibers of the glove base element 1, it is preferable to apply various penetration prevention treatments to the outer surface of the glove base element 1 on which the first coating liquid is to be applied. The penetration prevention treatments include coagulant coating, water-repellent treatment, and oil-repellent treatment. A coagulant used in the coagulant coating includes a multivalent cation salt such as calcium nitrate and zinc chloride, and organic acid such as acetic acid and citric acid, and a solvent of the coagulant includes water and methanol. A water-repellent agent used in the water-repellent treatment includes a silicone-based treatment agent, and a fluorine treatment agent, and an oil-repellent agent used in the oil-repellent treatment includes fluorine treatment agent. The penetration prevention treatments described above may be individually performed or may be performed in combination with each other. To increase effect of the penetration prevention treatment described above, viscosity of the first coating liquid is preferably increased to 2000 mPa·s or more when measured under the condition of V6 by using the B-type viscometer.

The glove base element 1 coated with the first coating liquid is dried by a heater such as an oven, and the first resin coating 2 is formed in the glove base element 1. The glove base element 1 in which the first resin coating 2 is formed is removed from a hand model. When chemicals such as a coagulant, a water-repellent agent, and an oil-repellent agent, are used, the glove base element 1 in which the first resin coating 2 is formed may be cleaned with water or the like to remove surplus chemicals. The cleaning above may be performed while the glove base element 1 is put on the hand model, or after the glove base element 1 is removed from the hand model.

(Inner Glove Disposing Step: S2)

In the present step, the inner glove 3 is disposed inside the glove base element 1 in which the first resin coating 2 is formed. The inner glove 3 is formed so as to have a volume fraction of solid contents per unit volume that is less than that of the glove base element 1. The inner glove 3 can be disposed by putting the glove base element 1 in which the first resin coating 2 is formed, on an outer surface of the inner glove 3 put on a metal flat mold so that the outer surface of the inner glove 3 is covered with the glove base element 1.

The inner glove 3 disposed inside the glove base element 1 may be integrated with the glove base element 1. When a thread is used to integrate the glove base element 1 with the inner glove 3, the glove base element 1 is put on the outer surface of the inner glove 3 so as to cover the outer surface, and then a cuff of the glove base element 1 and a cuff of the inner glove 3 are sewn together. In addition, when an adhesive is used to integrate the glove base element 1 with the inner glove 3, the adhesive is previously applied to positions to be bonded on the outer surface of the inner glove 3 before the outer surface of the inner glove 3 is covered with the glove base element 1.

Through the first resin coating forming step (S1) and the inner glove disposing step (S2), described above, the supporting glove 10 according to the first embodiment of the present invention is manufactured.

While an example of performing the inner glove disposing step (S2) after the first resin coating forming step (S1) is performed is described above, the order of performing the first resin coating forming step (S1) and the inner glove disposing step (S2) can be appropriately determined, and thus the first resin coating forming step (S1) can be performed after the inner glove disposing step (S2) is performed. That is, while the inner glove 3 is disposed inside the glove base element 1, the first resin coating 2 can be formed.

Subsequently, a method for manufacturing the supporting glove 10 according to the second embodiment will be described.

To manufacture the supporting glove 10 according to the present embodiment, the method for manufacturing the supporting glove 10, of the present invention, includes the step of forming a second resin coating. The step of forming a second resin coating is performed by applying a second coating liquid for forming a second resin coating 4 to at least a part of the outer surface of the first resin coating 2. From the viewpoint of reinforcement, the second coating liquid is preferably prepared so that a volume fraction of solid contents per unit volume of the second resin coating 4 is more than a volume fraction of solid contents per unit volume of the first resin coating 2.

The second coating liquid contains resin. Examples of the resin includes the various kinds of publicly known resin described above. A suitable resin can be used from among the various kinds of publicly known resin depending on purpose. For example, when the second resin coating 4 is intended to be improved in strength and ease of processing, it is preferable to use latex such as natural rubber and nitrile-butadiene rubber. In this case, the second coating liquid is prepared to have a ratio of solid contents of 20 to 60 mass %. The ratio of solid contents is adjusted by using water and the like. In addition, the second coating liquid may contain various compounding agents similar to those shown by example in the first coating liquid at respective ratios similar to those shown by example in the first coating liquid.

Viscosity of the second coating liquid is preferably 500 to 4000 mPa·s when measured under the condition of V6 by using the B-type viscometer.

When the second resin coating 4 is formed into a non-porous resin coating, the second coating liquid in an original state without being foamed is applied.

When the second resin coating 4 is formed into a foamed coating, the second coating liquid is foamed as described in the first resin coating forming step (S1). When the second coating liquid is foamed, a volume fraction of bubbles in the second coating liquid is preferably not less than 5 volume % and not more than 40 volume %. A volume fraction of 5 volume % or more improves flexibility of the glove when formed into the second resin coating 4, as well as grip force against water and oil. In addition, deterioration in permeability of the supporting glove 10 can be reduced depending on combination with the first resin coating 2. A volume fraction of 40 volume % or less improves durability when formed into the second resin coating 4. The volume fraction of bubbles in the second coating liquid can be acquired as with the first coating liquid.

To increase grip force of the second resin coating 4, the second coating liquid can contain at least one kind of resin selected from among natural rubber, nitrile-butadiene rubber, and polyurethane. Alternatively, the second coating liquid can contain anti-slip particles such as fine powder of natural rubber, nitrile-butadiene rubber, styrene-butadiene rubber, or the like.

In addition, to reduce humidity in the glove, moisture permeable polyurethane can be contained.

The second coating liquid is applied so as to cover at least a part of the outer surface of the first resin coating 2 on the palm side and the dorsal side of the glove base element 1 by a method similar to that used for the first coating liquid. From the viewpoint of facilitating stable and uniform application of the second coating liquid, as a technique of applying it, it is preferable to use dip coating as with the first coating liquid.

Applying a solution containing a coagulant to the outer surface of the first resin coating 2 to which the second coating liquid is to be applied enables the second resin coating 4 to be formed thick. Meanwhile, if concentration of a coagulant in the solution is high, the second resin coating 4 that can be acquired by drying the second coating liquid may peel. Thus, the concentration of a coagulant is appropriately set at a value at which the second resin coating 4 does not peel.

When resin contained in the second coating liquid is different from resin contained in the first coating liquid, it is preferable to provide an adhesive layer on the outer surface of the first resin coating 2 to which the second coating liquid is to be applied. The adhesive layer can be formed by applying one of various kinds of publicly known adhesive such as acrylic-based and urethane-based adhesive by using shower coating, spray coating, dip coating, or the like. The adhesive may be dried after application.

In addition, an anti-slip pattern can be formed in the second resin coating 4 by various kinds of publicly known method. For example, the anti-slip pattern may be formed as follows: water-soluble particles are brought into contact with a surface of the second coating liquid after application for a predetermined time, and then the water-soluble particles are cleaned off to form the anti-slip pattern; or the surface of the second coating liquid after application is dried to a predetermined state, and then a surface of the dried second coating liquid is soaked in an organic solvent to form a swelling pattern. A technique of soaking the surface in an organic solvent is preferable in that an anti-slip pattern can be easily formed.

The glove base element 1 coated with the second coating liquid is dried by a heater such as an oven, and the second resin coating 4 is formed in at least a part of the outer surface of the first resin coating 2. When chemicals such as a coagulant and the like are used, the glove base element 1 in which the second resin coating 4 is formed may be cleaned with water or the like to remove surplus chemicals, as with the first resin coating forming step (S1).

After the second resin coating 4 is formed, the supporting glove 10 according to the second embodiment is manufactured through the inner glove disposing step (S2).

While an example of performing the inner glove disposing step (S2) after the step of forming the second resin coating is performed is described above, the order of performing the step of forming the second resin coating and the inner glove disposing step (S2) can be appropriately determined. Thus, the step of forming the second resin coating can be performed after the inner glove disposing step (S2) is performed. That is, while the inner glove 3 is disposed inside the glove base element 1, the second resin coating 4 can be formed.

Since the supporting glove of the present embodiment is formed as described above, the supporting glove has the following advantages.

The supporting glove according to the present embodiment includes a glove base element made of fiber material, a resin coating applied to at least a part of an outer surface of the glove base element, and an inner glove made of fiber material provided inside the glove base element, wherein a relational expression of $d_2<d_1$ is satisfied where $d_1$ is a volume fraction of solid contents per unit volume of the glove base element, and $d_2$ is a volume fraction of solid contents per unit volume of the inner glove.

In the supporting glove described above, the inner glove made of fiber material is provided inside the glove base element, and a volume fraction of solid contents per unit volume of the inner glove is less than a volume fraction of solid contents per unit volume of the glove base element. Thus, the supporting glove can sufficiently hold air with low thermal conductivity, increases its flexibility, and can be easily deformed by pressure applied when an object is held, as compared with a supporting glove with the same thickness and without the inner glove described above.

This allows the supporting glove described above to be relatively excellent in keeping warmth and flexibility, as well as allows tactile feeling when an object is held to easily reach the hands.

In the supporting glove above, the resin coating may be a foamed coating containing air cells.

According to the structure, the supporting glove above has more increase in flexibility and keeping warmth.

In addition, in the supporting glove, at least a part of an outer surface of the inner glove and at least a part of an inner surface of the glove base element may be bonded to each other.

According to the structure, the inner glove is prevented from coming out from the glove base element by following movement of the hand of the wearer when the supporting glove is removed.

In the supporting glove in which the at least a part of an outer surface of the inner glove and the at least a part of an inner surface of the glove base element are bonded to each other, a cuff of the inner glove and a cuff of the glove base element are bonded to each other as well as fingertips of the inner glove and corresponding fingertips of the glove base element are bonded to each other, and on a dorsal side, portions corresponding to first joints and second joints of fingers in finger members of the inner glove, and portions corresponding to the first joints and the second joints thereof in finger members of the glove base element, may not be bonded to each other.

According to the structure above, stretched feeling when the wearer moves their fingers is reduced.

Since the method for manufacturing the supporting glove of the present embodiment is formed as described above, the method has the following advantages.

The method for manufacturing the supporting glove of the present embodiment is for the supporting glove including a glove base element made of fiber material, and a resin coating applied to at least a part of an outer surface of the glove base element, and the method includes the steps of applying coating liquid containing resin for forming the resin coating to at least a part of an outer surface of the glove base element to form the resin coating; and disposing an inner glove inside the glove base element, the inner glove having a volume fraction of solid contents per unit volume that is less than a volume fraction of solid contents per unit volume of the glove base element.

According to the method for manufacturing the supporting glove, it is possible to acquire a supporting glove that is relatively excellent in keeping warmth and flexibility, and that allows tactile feeling when an object is held to easily reach the hands.

In the above method for manufacturing the supporting glove, the coating liquid may be foamed.

According to the structure, more increase in flexibility and keeping warmth of the supporting glove acquired can be achieved.

In addition, in the above method for manufacturing the supporting glove, at least a part of an outer surface of the inner glove and at least a part of an inner surface of the glove base element may be bonded to each other in the inner glove disposing step.

According to the structure, the inner glove can be prevented from coming out from the glove base element by following movement of the hand of the wearer when the supporting glove acquired is removed.

Further, in the above method for manufacturing the supporting glove in which the at least a part of the outer surface of the inner glove and the at least a part of the inner surface of the glove base element are bonded to each other in the inner glove disposing step, a cuff of the inner glove and a cuff of the glove base element are bonded to each other as well as fingertips of the inner glove and corresponding fingertips of the glove base element are bonded to each other, and on a dorsal side, portions corresponding to first joints and second joints of fingers in finger members of the inner glove, and portions corresponding to the first joints and the second joints thereof in finger members of the glove base element, may not be bonded to each other.

According to the above structure, stretched feeling when the wearer moves their fingers can be reduced in the supporting glove acquired.

EXAMPLES

Hereinafter, the present invention will be described in more detail by using examples of the present invention. The examples below are used to describe the present invention in more detail, and thus no longer limit a scope of the present invention.

Example 1

A supporting glove according to an example 1 was formed by using material below.

(Glove Base Element)

The glove base element 1 was formed by flat knitting using two woolly nylon two-fold yarns with a glove knitting machine (Shima Seiki Mfg., Ltd, Model 13G SFG), in which each of the two woolly nylon two-fold yarn was formed by twisting two wooly nylon single yarns. The wooly nylon single yarn was 77 dtex and the wooly nylon two-fold yarn was 154 dtex so that the total size of two woolly nylon two-fold yarns corresponded to 308 dtex.

The glove base element had a thickness of 0.59 mm, a density of 0.302 g/cm$^3$, and a volume fraction of solid contents per unit volume of 26.5 volume %. The thickness of the glove base element was measured by using a constant pressure thickness gauge (TECLOCK Corp., Model No. PG-15) under conditions where a pressurized load is 2.35 N, and a diameter of a probe is $\phi$11.3 mm, with no tension of stretching applied. The density was acquired by cutting out a measurement piece of 5 cm square from the glove base element 1, measuring a value of a volume of the measurement piece, and dividing the value of mass of the measured measurement piece by a value of a volume of the measurement piece calculated by multiplying a thickness of the glove base element by a value of an area of the measurement piece. The cut out measurement piece of 5 cm square had a mass of 0.445 g. The volume fraction of solid contents per unit volume was calculated from the density acquired as described above and specific gravity of the woolly nylon two-fold yarn. The specific gravity of the woolly nylon yarn was acquired in accordance with JIS L 1013: 2010.

(First Resin Coating)

The glove base element was put on a metallic solid hand model, and the solid hand model was heated to 60° C.

Next, the heated solid hand model was dipped into a methanol solution (coagulant) containing 5 volume % of acetic acid up to its wrist portion to apply a coagulant to an outer surface of the glove base element.

Subsequently, to form a first resin coating, the glove base element after coated with the coagulant was dipped into a first coating liquid up to its wrist portion to apply the first coating liquid to a part of the outer surface of the glove base element, and then the glove base element 1 after application was dried in an oven at 120° C. for ten minutes to form the first resin coating in a part of the outer surface of the glove base element.

A volume fraction of solid contents per unit volume of the first resin coating was 54 volume %. The volume fraction described above was acquired by the following method. First, while any cross section of the first resin coating in a direction oblique to a knitting (weaving) direction of the glove base element was observed at 100-fold magnification, for example, using the digital microscope (Keyence Corp., model No. VHX-900), a starting point was set on the first resin coating. Next, with respect to cross section areas of the first resin coating, defined within a distance of 3 mm in a direction orthogonal to a thickness direction of the first resin coating from the starting point, a volume fraction was calculated from an area of each of the cross section areas and an area of a void included in each of the cross section areas. This calculation was performed at five places in the direction orthogonal to the thickness direction of the first resin coating, and the volume fraction described above was acquired by arithmetically averaging the calculation values.

A penetration ratio of the first resin coating with respect to thickness of the glove base element was 31%. The penetration ratio described above was acquired by dividing thickness of the first resin coating penetrating into the glove base element by thickness of the glove base element when the first resin coating 2 was penetrated.

The thickness of the glove base element when the first resin coating was penetrated was acquired by the following method. First, while any cross section in a direction oblique to the knitting (weaving) direction of the glove base element into which the first resin coating penetrates was observed at 50-fold magnification, using the digital microscope (Keyence Corp., model No. VHX-900), a starting point was set in the cross section. Next, there was set a cross section area defined within a distance of 6 mm in a direction orthogonal to a thickness direction of the glove base element from the starting point. In the cross section area, four raised portions (fiber bundles used in knitting or weaving) of the glove base element on a side being in contact with the first resin coating were selected, and first perpendiculars were drawn toward an edge face of the glove base element on a side without being in contact with first resin coating (the side opposite to the first resin coating) from apexes of the raised portions, respectively, and then points (first orthogonal points) at each of which the edge face and each of the first perpendiculars intersected with each other was acquired. Subsequently, each distance from the apex of each of the raised portions to one of the corresponding first orthogonal points was measured, and the thickness of the glove base element 1 when the first resin coating 2 was penetrated was acquired by arithmetically averaging the measurement values.

The thickness of the first resin coating penetrating into the glove base element was acquired by the following method. The apexes of the raised portions were connected to each other by a virtual line, respectively. Next, ten points were randomly selected in a rim of the first resin coating on a glove base element side, and second perpendiculars were drawn toward the virtual line from the points, respectively, and then points (second orthogonal points) at each of which the virtual line and each of the second perpendiculars intersected with each other was acquired. Subsequently, each distance from the rim of the first resin coating to each of the second orthogonal points was measured, and the thickness of the first resin coating penetrating into the glove base element was acquired by arithmetically averaging the measurement values.

The penetration ratio was calculated at five places in a direction orthogonal to a thickness direction of the glove base element, and was acquired by arithmetically averaging the calculation values.

The first coating liquid was prepared by diluting a composite containing composition raw materials shown in Table 1 with ion exchanged water so that a ratio of solid contents becomes 53 mass %, and was stirred using an electric whisk so as to cause bubbles of 25 volume %. Viscosity of the first coating liquid was 2900 mPa·s when measured under a condition of V6 (rotation speed was 6 rpm, and temperature was 25° C.) by using a B-type viscometer. That is, the first resin coating according to the example 1 was a foamed coating.

TABLE 1

| Composition raw material | Compounding ratio (mass parts of solid contents) |
|---|---|
| NR latex (SUNWISE Co., Ltd.-made LA-TZ) | 100 |
| 10% KOH | 1.00 |
| Colloidal sulfur | 1.00 |
| Zinc oxide | 1.00 |
| Vulcanizing accelerator (zinc diethyldithiocarbamate) | 0.50 |
| Antioxidant (2,2'-methylenebis(4-ethyl-6-tert-butylphenol)) | 1.00 |
| VIVASHIELD9176 | 6.00 |
| Titanium oxide | 1.50 |
| Cellulosic thickener (NITROSOL) | 0.35 |
| 30% solution of disodium N-octadecyl sulfosuccimate | 0.30 |

* As compounding ratio, calculated values acquired by using composition raw material as solid contents are described.

(Second Resin Coating)

After the first resin coating was formed on the outer surface of the glove base element, the solid hand model was heated to 60° C. again. Next, a body section and an extended section on a palm side of the glove base element were dipped in a second coating liquid for forming a second resin coating so that the second coating liquid was applied to a part of an outer surface of the first resin coating. Then, only the surface of the second coating liquid was dried to form a coating of the second coating liquid on a part of the outer surface of the first resin coating. After that, a portion where the coating of the second coating liquid was formed was soaked in hexane so that a swelling pattern was formed on a surface of the coating of the second coating liquid. Then, the glove base element after soaked in the hexane was dried in an oven at 130° C. for thirty minutes to form the second resin coating on a part of the outer surface of the first resin coating.

A volume fraction of solid contents per unit volume of the second resin coating was 100%. That is, the second resin coating according to the example 1 was a nonporous resin coating. Density and the volume fraction of solid contents per unit volume of the second resin coating were acquired as with the first resin coating. The glove base element in which the first and second resin coatings were formed was removed from the solid hand model, and was dried after washed with water. The second coating liquid was prepared by diluting a composite containing composition raw materials shown in Table 2 with ion exchanged water so that a ratio of solid contents becomes 52%. Viscosity of the second coating liquid was 3100 mPa·s when measured under a condition of V6 by using the B-type viscometer.

TABLE 2

| Composition raw material | Compounding ratio (mass parts) |
|---|---|
| NR latex (SUNWISE Co., Ltd.-made LA-TZ) | 100 |
| 10% KOH | 1.00 |
| Colloidal sulfur | 1.00 |
| Zinc oxide | 1.00 |
| Vulcanizing accelerator (zinc diethyldithiocarbamate) | 0.50 |
| Antioxidant (2,2'-methylenebis(4-ethyl-6-tert-butylphenol)) | 1.00 |
| VIVASHIELD9176 | 6.00 |
| Titanium oxide | 1.50 |
| Cellulosic thickener (NITROSOL) | 0.45 |

* As compounding ratio, calculated values acquired by using composition raw material as solid contents are described.

(Inner Glove)

The inner glove was formed by pile knitting using two acrylic spun two-fold yarns with a glove knitting machine (Shima Seiki Mfg., Ltd, Model No. 10G SPG), in which each of the two acrylic spun yarns was formed by two acrylic spun single yarns. The acrylic spun single yarn was 40 metric count and the acrylic spun yarn was 20 metric count so that the total size of the two acrylic spun yarns corresponded to 10 metric count. Thickness of the inner glove was 1.46 mm, and mass of a measurement piece cut into 5 cm square was 0.900 g. Density thereof was 0.246 g/cm$^3$, and a volume fraction of solid contents per unit volume thereof was 21.3 volume %. The thickness, the density, and the volume fraction of solid contents per unit volume, of the inner glove, were acquired as with the glove base element. Specific gravity of the acrylic spun yarn was acquired in accordance with JIS L 1013.

(Supporting Glove)

The inner glove was inserted into the glove base element above to acquire the supporting glove according to the example 1.

Example 2

A supporting glove according to an example 2 was formed as with the example 1, except that an inner glove was formed by flat knitting with a glove knitting machine of the Model No. 10G SFG of Shima Seiki Mfg., Ltd. Thickness of the inner glove was 0.92 mm, and mass of a measurement piece cut into 5 cm square was 0.538 g. Density was 0.234 g/cm$^3$, and a volume fraction of solid contents per unit volume was 20.3 volume %. The thickness, the density, and the volume fraction of solid contents per unit volume, of the inner glove, were acquired as with the glove base element according to the example 1.

Example 3

A supporting glove according to an example 3 was formed as with the example 1, except that an inner glove was formed by flat knitting with a glove knitting machine of the Model No. 7G SFG of Shima Seiki Mfg., Ltd. Thickness of the inner glove was 0.87 mm, and mass of a measurement piece cut into 5 cm square was 0.478 g. Density was 0.220 g/cm$^3$, and a volume fraction of solid contents per unit volume was 19.0 volume %. The thickness, the density, and the volume fraction of solid contents per unit volume, of the inner glove, were acquired as with the glove base element according to the example 1.

Example 4

A supporting glove according to an example 4 was formed as with the example 1, except that a method for forming a first resin coating and a second resin coating was changed as described below.

(First Resin Coating)

A glove base element put on a metallic solid hand model was heated to 60° C., and then the heated solid hand model was dipped into a methanol solution (coagulant) containing 1 weight % of calcium nitrate up to its wrist portion to apply a coagulant to an outer surface of the glove base element.

Subsequently, the glove base element after coated with the coagulant was dipped into a second coating liquid up to its wrist portion to apply the second coating liquid to a part of the outer surface of the glove base element, and then the glove base element after application was dried in an oven at 80° C. for ten minutes to form the first resin coating on a part of the outer surface of the glove base element. That is, the first resin coating according to the example 4 was a nonporous resin coating. In addition, a penetration ratio of the first resin coating with respect to thickness of the glove base element was 28%. The penetration ratio above was acquired as with the first resin coating according to the example 1.

(Second Resin Coating)

A palm face of the glove base element after the first resin coating was formed was dipped in the first coating liquid, and was withdrawn to be dried in an oven at 80° C. for ten minutes, and then was dried in an oven at 130° C. for 30 minutes to form a second resin coating. That is, the second resin coating according to the example 4 was a foamed coating. The glove base element after the second resin coating was formed was removed from the hand model, and was dried after washed with water.

Comparative Example 1

A supporting glove according to a comparative example 1 was formed as with the example 1, except that an inner glove was formed by flat knitting with a glove knitting machine of the Model No. 13G N-NSFG of Shima Seiki Mfg., Ltd. Thickness of the inner glove was 1.13 mm, and weight of a measurement piece cut into 5 cm square was 0.873 g. Density was 0.309 g/cm$^3$, and a volume fraction of solid contents per unit volume was 26.8 volume %. The thickness, the density, and the volume fraction of solid contents per unit volume, of the inner glove, were acquired as with the glove base element according to the example 1.

[Difference in Performance Due to Difference in Structure of Inner Glove]

Table 3 shows difference in keeping warmth, flexibility, and tactile feeling, due to difference in structure of an inner glove. A method of evaluating each of the keeping warmth, the flexibility, and the tactile feeling, is described below. The flexibility and the tactile feeling were evaluated by sensory evaluation.

(Evaluation of Keeping Warmth)

A piece cut into 8 cm square from a palm side of a supporting glove was used as a specimen. First, a thermocouple thermometer (A&D Company Ltd., Model No. AD-5602) was placed on a polyester ground fabric. Then, the specimen was placed so that its inner glove side was brought into contact with the thermocouple thermometer, and an indicated value of the thermocouple thermometer when the specimen was placed was recorded. Next, an ice block (250 g, and an area of a contact face was 28 cm$^2$) frozen at −20° C. for 24 hours was placed on the specimen, and indicated values of the thermometer after elapse of 30 seconds and 60 seconds were recorded. It was evaluated that a specimen with a smaller decrease in temperature had a higher capability of keeping warmth.

(Evaluation of Flexibility and Tactile Feeling)

Ten panelists each wearing a supporting glove were allowed to perform operation of picking soybeans placed on one dish to move them to the other dish. Then, a sense of feeling when this operation was performed was selected from among level scales described below by each of the panelists.

Level Scales of Flexibility

1: The glove felt soft;

2: The glove sometimes felt hard through the operation while generally feeling soft;

3: The glove felt hard during the operation, but not at a level that was distracting; and 4: The glove felt hard at a distracting level during the operation.

Level Scales of Tactile Feeling

1: It felt that tactile feeling of the soybean reached the hand well;

2: It felt that tactile feeling of the soybean reached the hand; and

3; It felt that tactile feeling of the soybean did not easily reach the hand.

Scale values of the flexibility and the tactile feeling, described in Table 3, were acquired by rounding off a value acquired by arithmetically averaging scale values replied by the ten panelists.

TABLE 3

| | | Example 1 | Example 2 | Example 3 | Comparative example 1 |
|---|---|---|---|---|---|
| Volume fraction of solid contents per unit volume of glove base element (Volume %) | | 26.5 | | | |
| Volume fraction of solid contents per unit volume of inner glove (Volume %) | | 21.3 | 20.3 | 19 | 26.8 |
| Thickness of inner glove (mm) | | 1.46 | 0.92 | 0.87 | 1.13 |
| Change with time of measured temperature (° C.) | 0 | 23.0 | 23.0 | 23.0 | 23.0 |
| | 30 seconds later | 19.4 | 17.2 | 17.7 | 16.2 |
| | 60 seconds later | 14.6 | 11.7 | 12.0 | 10.3 |
| Evaluation of flexibility | | 2 | 1 | 1 | 4 |
| Evaluation of tactile feeling | | 2 | 2 | 1 | 3 |

According to Table 3, it was found that the specimen cut out from the supporting glove according to each of the examples 1 to 3 had a smaller decrease in temperature with time and a higher capability of keeping warmth as compared with the specimen cut out from the supporting glove according to the comparative example 1. In addition, from the evaluation results of the flexibility and the tactile feeling, it was found that the supporting glove according to each of the examples 1 to 3 was superior to the supporting glove according to the comparative example 1 in both the flexibility and the tactile feeling.

[Difference in Performance Due to Difference in Method of Forming First Resin Coating and Second Resin Coating]

Table 4 shows difference in capability of keeping warmth and flexibility due to difference in methods of forming the first resin coating and the second resin coating. The capability of keeping warmth was evaluated as described above. The flexibility was evaluated as described below.

(Evaluation of Flexibility)

A piece cut out into a width of 30 mm by a length of 80 mm, in a direction orthogonal to a lengthwise direction of the middle finger member, from a knuckle portion on a dorsal side of the supporting glove, was used as a specimen. The specimen was pulled at a tension speed of 100 mm/min with a tester of a desk type precision universal tester (Shimadzu Corp., Model No. AGS-J) while a distance between chucks was set at 60 mm, and indicated values of force, applied to the specimen when the specimen was elongated by 10 mm, 20 mm, and 30 mm, were recorded. This simulated stretched feeling in a knuckle portion when the hand grips an object, and it was determined that smaller force applied to elongate the specimen reduced stretched feeling, and that the specimen had more flexibility.

TABLE 4

| | | Example 1 | Example 4 |
|---|---|---|---|
| Structure of glove (Description from outermost face) | | Nonporous resin coating<br>Foamed coating<br>Glove base element<br>Inner glove | Foamed coating<br>Nonporous resin coating<br>Glove base element<br>Inner glove |
| Change with time of measured temperature (° C.) | 0 | 21.2 | 21.2 |
| | 30 seconds later | 19.0 | 17.0 |
| | 60 seconds later | 14.3 | 11.8 |
| Flexibility (N) | 10 mm | 2.9 | 8.9 |
| | 20 mm | 4.8 | 14.7 |
| | 30 mm | 6.6 | 19.3 |

According to Table 4, it was found that the specimen cut out from the supporting glove according to the example 1 had a smaller decrease in temperature with time and more flexibility as compared with the specimen cut out from the supporting glove according to the example 4.

Various embodiments and modifications are available to the present invention without departing from the broad spirit and the scope of the present invention. The embodiments and the examples, described above, are used to describe the present invention, and thus no longer limit the scope of the present invention. That is, the scope of the present invention is defined not by the embodiments and the examples, but by the claims. Thus, various modifications provided in the scope of claims and meaning of the invention, equivalent to the claims, are regarded to be within the scope of the present invention.

What is claimed is:

1. A supporting glove comprising:

a glove base element made of fiber material knitted by one of 13-gauge to 18-gauge glove knitting machines;

a first resin coating applied to at least a part of an outer surface of the glove base element; and an inner glove made of fiber material knitted by a 13-gauge or less glove knitting machine and provided inside the glove base element, wherein;

a thickness of the glove base element is 0.20 mm or more and 0.80 mm or less, a penetration ratio of the first resin coating with respect to the thickness of the glove base element is 5% or more and 75% or less, a cuff of the inner glove and a cuff of the glove base element are bonded to each other, and fingertips of the inner glove and corresponding fingertips of the glove base element are bonded to each other, on a dorsal side, portions of the inner glove formed to correspond to first joints and second joints of a wearer's fingers in finger members of the inner glove, and portions of the glove base element formed to correspond to the first joints and the second joints of the wearer's fingers in the finger members of the glove base element, are not bonded to each other, a relational expression of $d_2<d_1$ is satisfied wherein $d_1$ is a volume ratio of fiber material per unit volume 1 $cm^3$ of the glove base element, and $d_2$ is a volume ratio of fiber material per unit volume 1 $cm^3$ of the inner glove, $d_1$ being 15 volume % or more and 30 volume % or less, and $d_2$ is 10 volume % or more and 26 volume % or less, the first resin coating is a foamed coating containing air cells, a volume ratio of solid contents per unit volume 1 $cm^3$ of the first resin coating is 30 volume % or more and 90 volume % or less, and is more than a volume ratio of solid contents per unit volume 1 $cm^3$ of the glove base element, and the first resin coating is provided with no particle clustering regions.

2. The supporting glove according to claim 1, further comprising a second resin coating that covers at least a part of an outer surface of the first resin coating and has an outer surface, on which asperities are formed by any of: (a) forming the second resin coating using a resin comprising anti-slip particles; (b) treating the second resin coating with an organic solvent to form a swelling pattern; and (c) treating a surface of the second resin coating with deliquescent particles.

3. The supporting glove according to claim 2, wherein:

a volume ratio of solid contents per unit volume 1 $cm^3$ of the second resin coating is more than the volume ratio of solid contents per unit volume 1 $cm^3$ of the first resin coating, and $d_3$ is 70 volume % or more and 100 volume % or less, wherein $d_3$ is the volume ratio of solid contents per unit volume 1 $cm^3$ of the second resin coating.

4. The supporting glove according to claim 1, wherein the inner glove is made of fiber material knitted by one of 5-gauge to 10-gauge glove knitting machines and applied with nap-raising treatment, and has a thickness of 0.5 mm or more and 3.0 mm or less.

5. A method for manufacturing a supporting glove including a glove base element made of fiber material, and a first resin coating applied to at least a part of an outer surface of the glove base element, the method comprising:

a first resin coating forming step of applying coating liquid containing resin for forming the first resin coating to at least the part of the outer surface of the glove base element to form the first resin coating; and an inner glove disposing step of disposing an inner glove inside the glove base element, the inner glove having a volume fraction of solid contents per unit volume that is less than a volume fraction of solid contents per unit volume of the glove base element, wherein;

a thickness of the glove base element is 0.20 mm or more and 0.80 mm or less, a penetration ratio of the first resin coating with respect to the thickness of the glove base element is 5% or more and 75% or less, a cuff of the inner glove and a cuff of the glove base element are bonded to each other, and fingertips of the inner glove and corresponding fingertips of the glove base element are bonded to each other, on a dorsal side, portions of the inner glove formed to correspond to first joints and second joints of a wearer's fingers in finger members of the inner glove, and portions of the glove base element formed to correspond to the first joints and the second joints of the wearer's fingers in the finger members of the glove base element, are not bonded to each other, a relational expression of $d_2<d_1$ is satisfied wherein $d_1$ is a volume ratio of fiber material per unit volume 1 $cm^3$ of the glove base element, and $d_2$ is a volume ratio of fiber material per unit volume 1 $cm^3$ of the inner glove, $d_1$ being 15 volume % or more and 30 volume % or less, and $d_2$ is 10 volume % or more and 26 volume % or less, the first resin coating is a foamed coating containing air cells, a volume ratio of solid contents per unit volume 1 $cm^3$ of the first resin coating is 30 volume % or more and 90 volume % or less, and is more than a volume ratio of solid contents per unit volume 1 $cm^3$ of the glove base element, and the first resin coating is provided with no particle clustering regions.

6. The method for manufacturing a supporting glove according to claim 5, wherein the coating liquid is foamed.

* * * * *